US008800171B1

(12) United States Patent
Khaitan et al.

(10) Patent No.: US 8,800,171 B1
(45) **Date of Patent: *Aug. 12, 2014**

(54) FOOTWEAR INSOLE SYSTEM

(71) Applicant: Ukies LLC, Atlanta, GA (US)

(72) Inventors: Umesh K. Khaitan, Atlanta, GA (US); Kavita Khaitan, Atlanta, GA (US)

(73) Assignee: Ukies LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/183,031

(22) Filed: Feb. 18, 2014

Related U.S. Application Data

(63) Continuation of application No. 14/156,706, filed on Jan. 16, 2014.

(51) Int. Cl.

| | |
|---|---|
| ***A43B 13/38*** | (2006.01) |
| ***A43B 13/18*** | (2006.01) |
| ***A43B 13/40*** | (2006.01) |
| ***A43B 1/00*** | (2006.01) |
| ***A43B 7/14*** | (2006.01) |
| ***A43B 17/02*** | (2006.01) |
| ***A43B 21/00*** | (2006.01) |

(52) U.S. Cl.

CPC ..... *A43B 13/386* (2013.01); *A43B 13/40* (2013.01); *A43B 1/0009* (2013.01); *A43B 7/144* (2013.01); *A43B 7/1465* (2013.01); *A43B 7/1425* (2013.01); *A43B 13/189* (2013.01); *A43B 17/02* (2013.01); *A43B 7/1435* (2013.01); *A43B 17/026* (2013.01); *A43B 21/00* (2013.01); *A43B 7/148* (2013.01)

USPC ..... 36/44; 36/30 R; 36/28

(58) Field of Classification Search

CPC .... A43B 13/40; A43B 13/386; A43B 13/189; A43B 17/026; A43B 17/02; A43B 17/00; A43B 13/38; A43B 7/1425; A43B 7/1435; A43B 7/144; A43B 7/1465; A43B 7/148; A43B 1/0009; A43B 21/00

USPC ..... 36/44, 30 R, 28, 43, 154, 153

See application file for complete search history.

(56) References Cited

U.S. PATENT DOCUMENTS

| | | | | |
|---|---|---|---|---|
| 6,199,304 | B1 * | 3/2001 | Ludemann | 36/44 |
| 7,047,669 | B2 | 5/2006 | Polcek | |
| 7,107,704 | B2 | 9/2006 | Dennis et al. | |
| 7,484,318 | B2 | 2/2009 | Finkelstein | |
| 7,526,880 | B2 | 5/2009 | Polcek | |
| 7,685,741 | B2 * | 3/2010 | Friedman | 36/25 R |
| 7,805,859 | B2 | 10/2010 | Finkelstein | |
| 7,962,986 | B2 | 6/2011 | Dananberg | |
| D669,674 | S | 10/2012 | Vidal | |
| 8,479,414 | B2 | 7/2013 | Baker et al. | |
| 2008/0222918 | A1 | 9/2008 | Hesse | |

(Continued)

*Primary Examiner* — Ted Kavanaugh

(74) *Attorney, Agent, or Firm* — Gardner Groff Greenwald & Villanueva, PC

(57) ABSTRACT

A footwear insole system for use with an article of footwear including a base insole component and an upper insole component. The base insole includes a chassis and first and a second shock absorbing inserts. The upper insole includes a spacer panel, first and a second gel insert members, and a fabric sheet layer. The insole system may be permanently secured to an article of footwear or the insole system may be replaceable or interchangeable for installation and removal to and from an article of footwear by a user.

18 Claims, 6 Drawing Sheets

(56) References Cited

U.S. PATENT DOCUMENTS

| | | | | |
|---|---|---|---|---|
| 2009/0007455 | A1 | 1/2009 | Montgomery | |
| 2009/0188131 | A1* | 7/2009 | Doerer et al. | 36/88 |
| 2010/0146816 | A1 | 6/2010 | Cappaert et al. | |
| 2010/0180467 | A1 | 7/2010 | Singleton | |
| 2010/0205831 | A1* | 8/2010 | Cheskin et al. | 36/44 |
| 2010/0212188 | A1* | 8/2010 | Granger et al. | 36/44 |
| 2012/0227291 | A1 | 9/2012 | Rosenbaum | |
| 2013/0291398 | A1 | 11/2013 | Cappaert et al. | |
| 2013/0298423 | A1 | 11/2013 | Daem | |
| 2014/0068965 | A1* | 3/2014 | Vattes et al. | 36/10 |

* cited by examiner

FOOTWEAR INSOLE SYSTEM

CROSS-REFERENCE TO RELATED APPLICATION

This application is a continuation of U.S. patent application Ser. No. 14/156,706 filed Jan. 16, 2014, which is hereby incorporated herein by reference in its entirety.

TECHNICAL FIELD

The present invention relates generally to the field of footwear, and more particularly to an insole system for use with footwear.

BACKGROUND

To a person or wearer of footwear, it is commonly preferred that the footwear be comfortable and appealing. Typically, this is not a problem to a wearer of flat bottom shoes—most people can find an article of footwear that is at least comfortable and appealing to the person wearing the footwear. Unfortunately, as the footwear becomes appealing or dressier, for example—the heel of the footwear increasing in elevation as in womens' high heel footwear, the comfort declines drastically. Time and time again, high heel shoes fail to provide comfort to the wearer; additionally failing to provide other important factors such as the distribution of pressure of the wearer's foot and supporting the same while ensuring the foot stays odorless, fresh and dry.

Accordingly, needs exist for improved insole systems for use with footwear, and in particular for use with womens' high heeled shoes. It is to the provision of a footwear insole system meeting these and other needs that the present invention is primarily directed.

SUMMARY

In example embodiments, the present invention provides a footwear insole system. In one aspect, the insole system includes a base insole and an upper insole. The base insole includes a chassis and first and second shock absorbing inserts. The chassis includes an upper surface and a lower surface, a lateral side and a medial side, a heel end and a forefoot end, and a heel portion, a midfoot portion and a forefoot portion. The upper insole is generally configured for mounting to the upper surface of the chassis and includes a spacer panel, first and second gel insert members, and a fabric sheet layer.

In another aspect, the invention relates to an insole system for an article of footwear. The insole system includes a base insole and an upper insole. The base insole includes a chassis and first and a second shock absorbing inserts. The chassis has an upper surface and a lower surface, a lateral side and a medial side, a heel end and a forefoot end, and a heel portion, a midfoot portion, and a forefoot portion. The chassis defines a central well formed at the heel portion having a peripheral wall defined along the well at the heel portion and extending along the lateral and medial sides of the chassis until gradually tapering at the midfoot portion. In one example form, the peripheral wall defines an outer collar that is generally transverse the wall and between the wall and an outer contour of the chassis. First and second shock absorbing layers are mounted to the chassis wherein the first shock absorbing layer is mounted to at least a portion of the forefoot portion and the second shock absorbing layer is mounted to at least a portion of the central well at the heel portion. The upper insole includes a spacer panel having at least one opening formed therein, at least a first and a second gel insert, and a fabric sheet. The spacer panel includes a midfoot portion and a forefoot portion for extending along the midfoot and forefoot portions of the base insole, with the first gel insert being fitted within the opening of the spacer panel to be adjacent the first shock absorbing layer and the second gel insert abutting a portion of the spacer panel proximal the midfoot portion and being adjacent the second shock absorbing layer, and the fabric sheet mounted atop the spacer panel and at least the first and second gel inserts.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value.

Similarly, when values are expressed as approximations, by use of the antecedent "about," it will be understood that the particular value forms another embodiment.

Generally described, the present invention relates to a footwear insole system for providing support, comfort and protection to a wearer's foot, and to help keep the wearer's feet odorless, fresh and dry. In one embodiment, the footwear insole system is configured for dress shoes, for example, high heel womens' shoes. Alternately, the footwear insole system can be configured to be adapted to other types of dress footwear (men or women), casual footwear, athletic footwear, etc.

Figure 1:
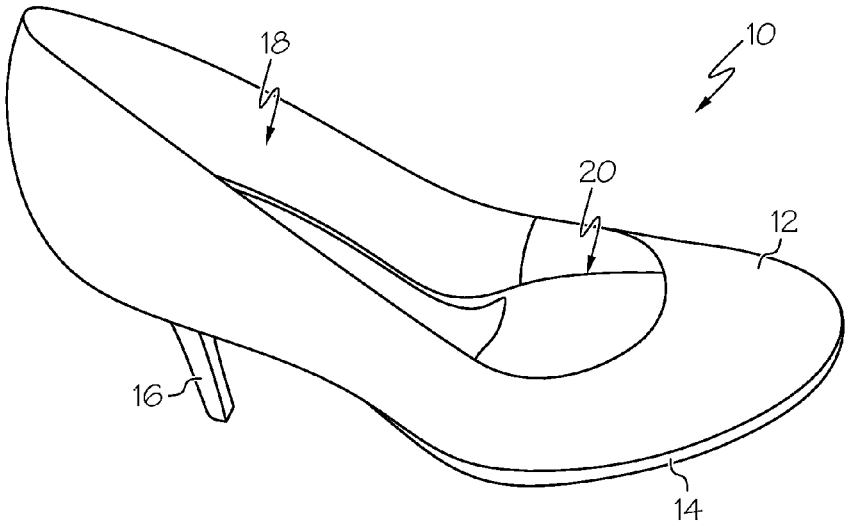
FIG. 1 is a side perspective view of an article of footwear comprising an insole system according to an example embodiment of the present invention.
Figure 2:
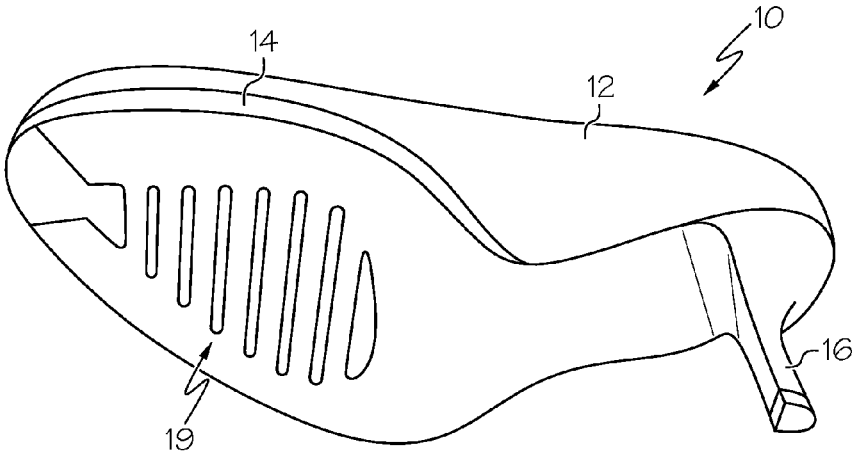
FIG. 2 is a bottom perspective view of the article of footwear of FIG. 1.

With reference now to the drawing figures, wherein like reference numbers represent corresponding parts throughout the several views, FIG. 1 shows an article of footwear 10 comprising an upper 12, an outer sole member 14 and an insole system 20. In one example embodiment, the article of footwear 10 is in the form of a high heel shoe, which can generally comprise a heel 16 extending a distance downward from the heel or rear end of the outsole 14. As depicted, the heel is generally unitary with the outer sole member 14. The heel 16 can be sized and shaped as desired and comprise any length, thickness and/or style as desired by the manufacturer or wearer of the article of footwear 10. Generally, the upper 12 and the outer 14 are assembled together to form the outer structure of the article of footwear 10. An opening 18 is provided on the upper 12 and is preferably configured to receive the wearer's foot. The outer member 14 and optional heel 16 are generally configured to contact the ground during use of the article of footwear 10. A plurality of thermoplastic polyurethane (TPU) injected slip-resistant treads 19 may be provided on a bottom side of the outer member. Preferably, the treads 19 are generally flush or at the same level with the external surface of the outer sole 14. Alternatively, the treads 19 can extend slightly beyond, for example about 1-3 millimeters beyond, the external surface of the outer sole 14. As depicted, the treads 19 are generally shaped to resemble a teardrop in overall peripheral profile with a portion of the slip-resistant tread 19 extending from the front end of the teardrop to a keystone shaped or otherwise configured toe end, and can be co-molded or injection molded into the outer sole member 14, or otherwise formed. Optionally, other shapes or patterns can be provided. In one example form, the insole system 20 is permanently secured to the upper 12 within the opening 20. In another example form, the insole system 20 may be replaceable or interchangeable, to be installed or removed from the article of footwear 10 by insertion or removal through the opening 18. In example embodiments, portions of the insole system 20 can be generally built into the article of footwear 10 or permanently or semi-permanently attached when constructing the upper 12. Thus, as will be described below, at least a portion of the insole system 20 may be secured to the upper 12 regardless of whether the balance of the insole system 20 is permanently secured or replaceable therefrom.

Figure 3:
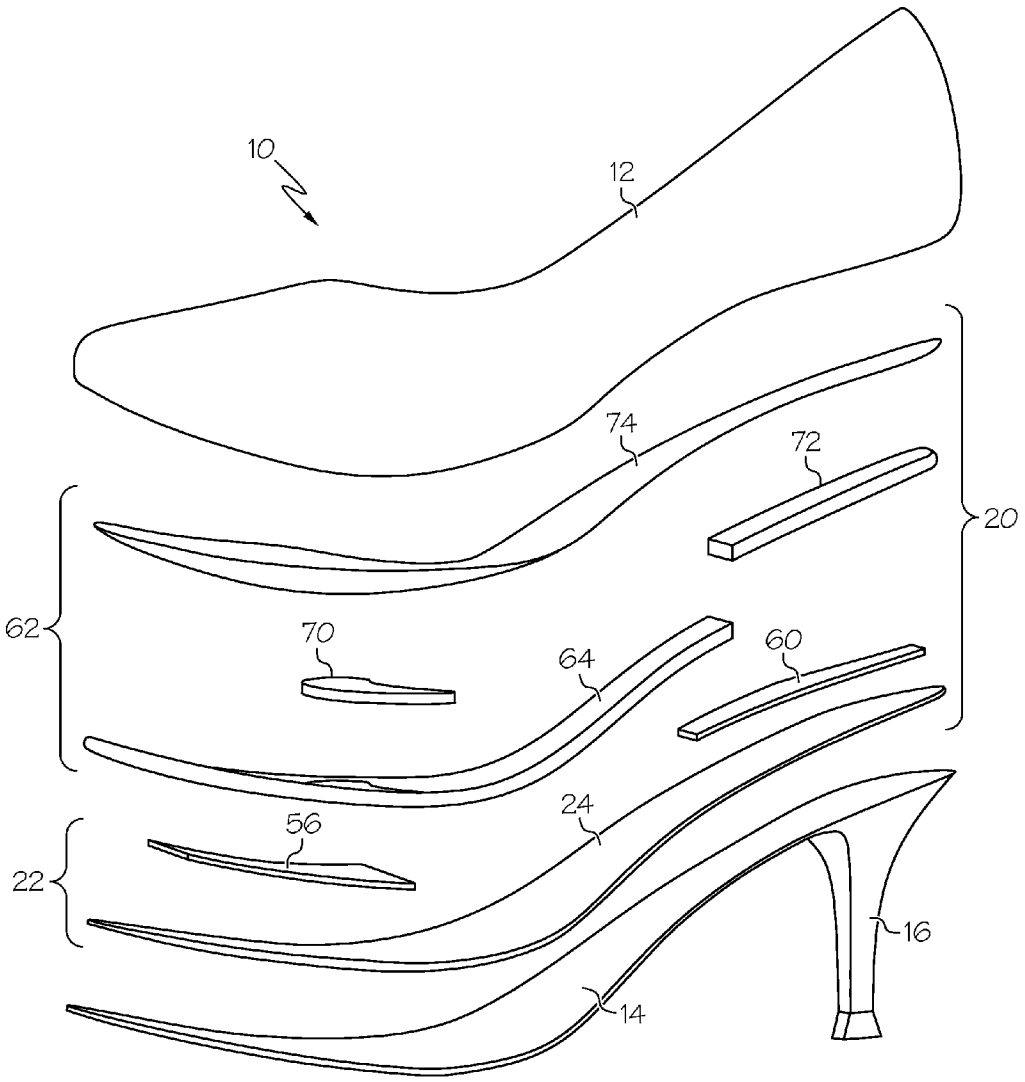
FIG. 3 is a side assembly view of the article of footwear of FIG. 1, showing the components of the insole system.

FIG. 3 shows an exploded or assembly view of the article of footwear 10 including the upper 12, the outer member 14 and the insole system 20. Generally, the upper 12 and outer member 14 are constructed of one or more materials such as other leather, synthetic leather, wood, plastic, polymer, composites, natural materials, synthetic materials, other materials and/or combinations thereof. In example forms, the upper 12 optionally comprises a midsole (unshown) to which the insole system 20 is affixed or mounted. Generally, the midsole, as is typical with footwear construction, is typically unitary with or affixed to the upper 12 when constructing the upper 12, which generally forms the bottom portion thereof. As such, to construct the article of footwear 10, the outer member 14 is affixed to the bottom portion of the upper 12 or external/exposed portion of the midsole (e.g., generally opposite the opening 18) and the insole system 20 is affixed or mounted to the midsole or interior portion of the upper 12 that is exposed therein (e.g., by inserting the insole system 20 within the opening 18). Thus, in example forms, the midsole is generally sandwiched between the outer member 14 and the insole system 20. Optionally, the upper 12 is constructed without the use of a midsole such that the outer member 14 is affixed to the bottom portion of the upper 12 and the insole system 20 is affixed within the upper 12 to a portion of the outer sole member 14 or an internal portion of the upper 12.

As will be described in greater detail below, example forms of the insole system 20 generally comprise a base insole 22 and an upper insole 62, which are generally affixed together to form the insole system 20. The base insole 22 generally comprises a base layer or chassis 24 and a first and a second (or fore and aft) shock absorbing insert 56, 60. The upper insole 62 generally comprises a central spacer panel or gel insert member receiver 64, first and a second (or fore and aft) gel insert members 70, 72 and a fabric cover sheet layer 74. In alternative embodiments, the first and second shock absorbing inserts 56, 60 and/or the first and second gel insert members 70, 72 may comprise unitary or continuous elements optionally incorporating intermediate connector webs or panels of reduced thickness interconnecting first and second primary sections of the inserts and/or members; and/or only a single shock absorbing insert and/or a single gel insert member may be included at either the fore or aft locations.

Figure 4:
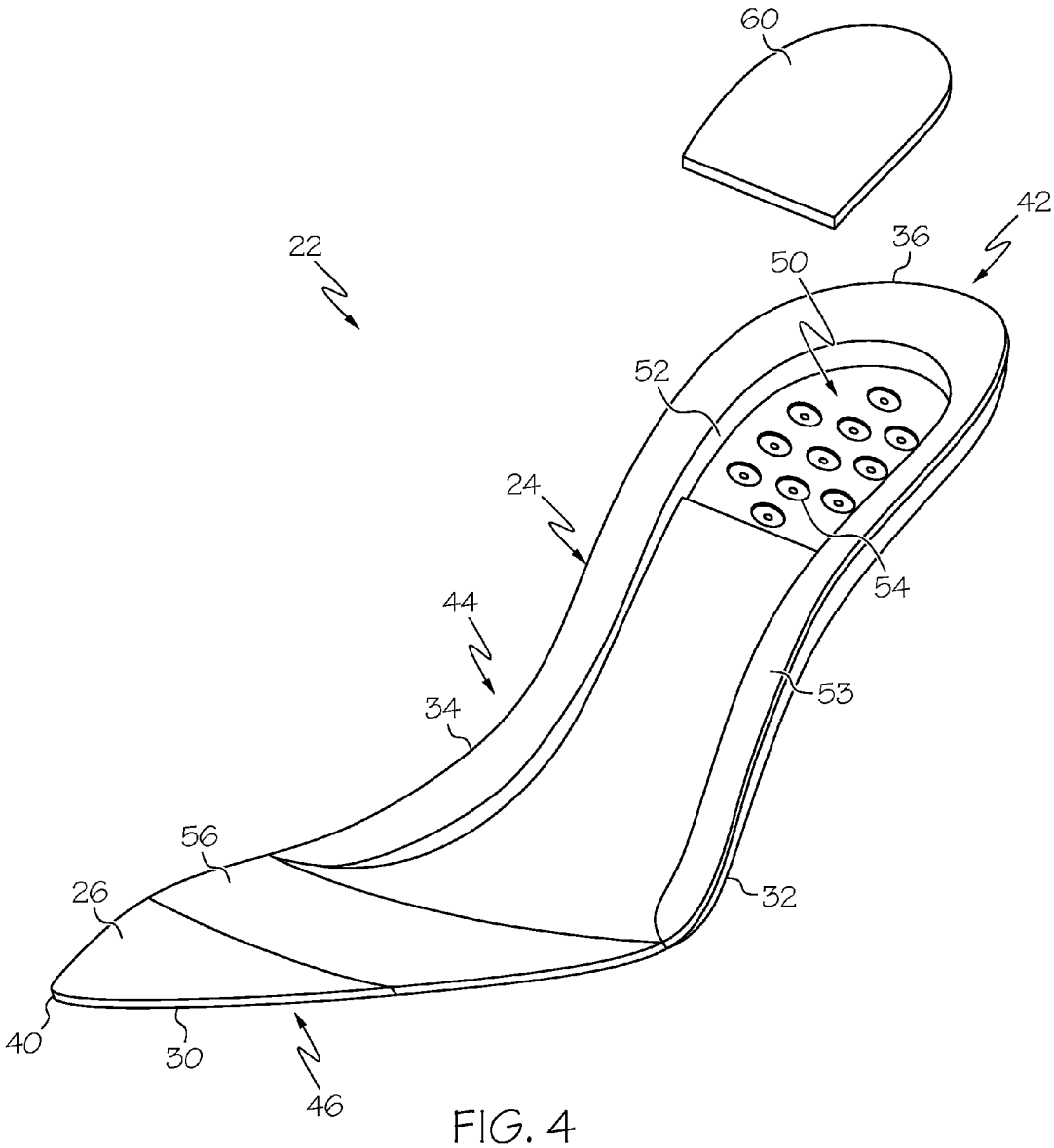
FIG. 4 is a perspective partial assembly view of a base insole of the footwear insole system of FIG. 3.

FIG. 4 shows the base insole 22 in greater detail. Generally, as briefly described above, the base insole 22 comprises the chassis or base layer 24 and first and second shock absorbing inserts 56, 60. Typically, the chassis 24 comprises an upper surface 26, a lower surface 30, a lateral side 32, a medial side 34, a heel or rear end 36, a forefoot or front end 40, a heel or rearward end portion 42, a midfoot portion 44 and a forefoot portion 46. As such, the chassis 24 is generally shaped to comprise an outer contour that is shaped to generally match the shape of a wearer's foot, and thus shaped similarly to the upper 12 that is it intended to be affixed or removably mounted to. As shown, the base insole 22 is generally arched as is typical for high heel shoes, with the heel of a wearer's foot elevated above the forefoot. Alternatively, the base insole 22 may be substantially flat or otherwise configured to accommodate for use in connection with various other types and styles of footwear.

In example forms, the heel portion 42 of the chassis 24 comprises a central recess, cup or well 50 that is generally spaced inwardly from the outer periphery of the heel portion 42. A peripheral wall 52 extends at least partially around the central well 50 along the rearward end 42 and the lateral and medial sides 32, 34 from the heel end of the chassis 24 and gradually tapering away (e.g., reducing in thickness or wall height) around the midfoot portion 44 or the forefoot portion 46. Preferably, the peripheral wall 52 defines an outer rim or collar 53 that is generally transverse the wall 52 and between the wall 52 and the outer contour of the chassis 24 such that an inner or central portion of the wearer's heel is positioned over the central well 50 and an outer or peripheral portion of the wearer's heel is positioned over the collar 53, providing improved weight distribution and comfort when worn. In some example forms, collar lip 53 may comprise a ramped or inclined surface generally sloping or tapering downwardly and inwardly towards the central well 50. As will be described below, the wall 52 defines an area for seating portions of the upper insole 62 therein, and the lip 53 provides a surface for affixing portions of the upper insole 62 thereto. Optionally, a surface defined within the central well 50 comprises a plurality of recessed apertures or indentions 54 countersunk therein to provide for the alignment and placement of one or more fasteners that can be used for attachment of the heel portion 42 to the upper 12. Alternatively or additionally, an adhesive or other attachment means can be used to affix the heel portion 42 to the upper 12.

The first and second shock absorbing inserts 56, 60 are typically affixed to the upper surface 26 of the chassis 24, for example, the first shock absorbing insert 56 being affixed between the forefoot portion 46 and the midfoot portion 44 and the second shock absorbing insert 60 being affixed within the central well 50. Generally, the outer contour of the central well 50 is substantially similar to the outer contour of the second shock absorbing insert 60 so that the insert is closely received within the well. In one form, the central well 50 is recessed below the upper surface 26 such that the upper surface of the second shock absorbing insert 60 is generally flush with the upper surface 26 when mounted thereto. Similarly, the upper surface of the first shock absorbing insert 56 is preferably flush with the upper surface 26 when affixed thereto (between the forefoot portion 46 and the midfoot portion 44). In one example form, a recessed channel or inset is provided within the base layer 24 such that the first shock absorbing insert 56 can be affixed within the recessed portion and remain flush with the upper surface 26. Optionally, the first shock absorbing insert 56 and the chassis 24 (generally near the forefoot portion 46) comprise a substantially similar thickness, and the first shock absorbing insert 56 is affixed between the forefoot portion 46 and the midfoot portion 44, for example, wherein it is the first shock absorbing insert 56 that couples the midfoot portion 44 to the forefoot portion 46. Optionally, the ends of the first shock absorbing layer 56 and the ends of the midfoot and forefoot portions 44, 46 (e.g., generally adjacent and abutting each other) can be mitered, dovetailed or overlayed to provide a smoother or improved transition and/or connection between the upper surface of the chassis 24 and the first shock absorbing layer 56.

In example forms, at least portions of the base insole 22 are permanently or semi-permanently secured to the upper 12 during the construction or assembly thereof. For example, in one example form, the chassis 24 and the first shock absorbing insert 56 are permanently secured to the upper 12 during the construction or assembly of the upper 12, and the second shock absorbing insert 60 and the upper insole 62 are separately installed (permanently secured or replaceable/interchangeable) in the upper 12. In alternate example forms, the base insole 22 and the upper insole 62 are installed after the construction of the upper 12, for example to then be permanently secured or replaceable/interchangeable with the upper 12. Optionally, the base insole 22 (or the chassis 24 and first shock absorbing insert 56) is/are permanently secured to the upper 12 and the upper insole 62 is replaceable/interchangeable with the upper 12.

Optionally, a generally rigid member or shank may be incorporated within the heel and/or forefoot portions 42, 44 to provide for enhancing or supporting the arched shape of the base insole 22 for improved comfort. Example shanks can be constructed from metal, plastic, composite, wood, natural materials, synthetic materials, other materials and/or combinations thereof. Alternatively, the outsole, base layer and/or other components of the footwear and/or the insole provide sufficient structural support and rigidity to eliminate the need for a shank.

In example embodiments, the base layer or chassis 24 is formed from high density polyethylene (HDPE) and the shock absorbing inserts 56, 60 are formed from polyurethane (PU). Optionally, the HDPE of the chassis 24 may include a microfiber overlayer or other fiberboard layer, which may comprise antimicrobial characteristics. In one example form, the shock absorbing inserts 56, 60 are formed from a specific polyurethane material, for example, Poron® XRD™ (available at www.poronxrd.com) that may vary in density from about 9 lb/ft$^3$ to about 25 lb/ft$^3$ and have a range of specific gravity from about 0.14 to about 0.40. Example qualities that may provide superior benefit to the shock absorbing inserts 56, 60 include but are not limited to performance advantage (consistent repeated impact absorption for dependable protection throughout the life of the product), wearable protection advantage (offers thin and flexible alternative to traditional padding, Microban® antimicrobial protection to help prevent growth of bacteria that causes stains, odors and product deterioration, breathable technology for ensuring ease of motion and air flow, contouring, and soft and flexible to the touch, offering the wearer a comfortable and customizable fit), design advantage (lightweight and low profile material technology, available in a variety of density/thickness combinations) and technologically advanced (soft to the touch, firm on impact, conforms to body's move, yet upon impact, forms a comfortable shell that protects the body, open-cell, breathable, excellent compression-set resistance, antifungal and does not contain latex, PVCs, VOCs or heavy metals). In example forms, to construct the base insole 12, the chassis 24 is preferably injection molded as a single piece and the shock absorbing inserts 56, 60 are affixed thereto with an adhesive or other attachment means, press-fit, co-molded, or otherwise constructed. Example forms of adhesives can include but are not limited to glue, resin, cement, or other various types of bonding materials. Optionally, the base insole 22 (chassis 24 and shock absorbing inserts 56, 60) may be constructed using various other manufacturing and assembly methods including cutting (e.g., die cutting, stamping, etc.), casting, molding, stitching, heat bonding, couplings, hook and loop material, tape, etc.

Figure 5:
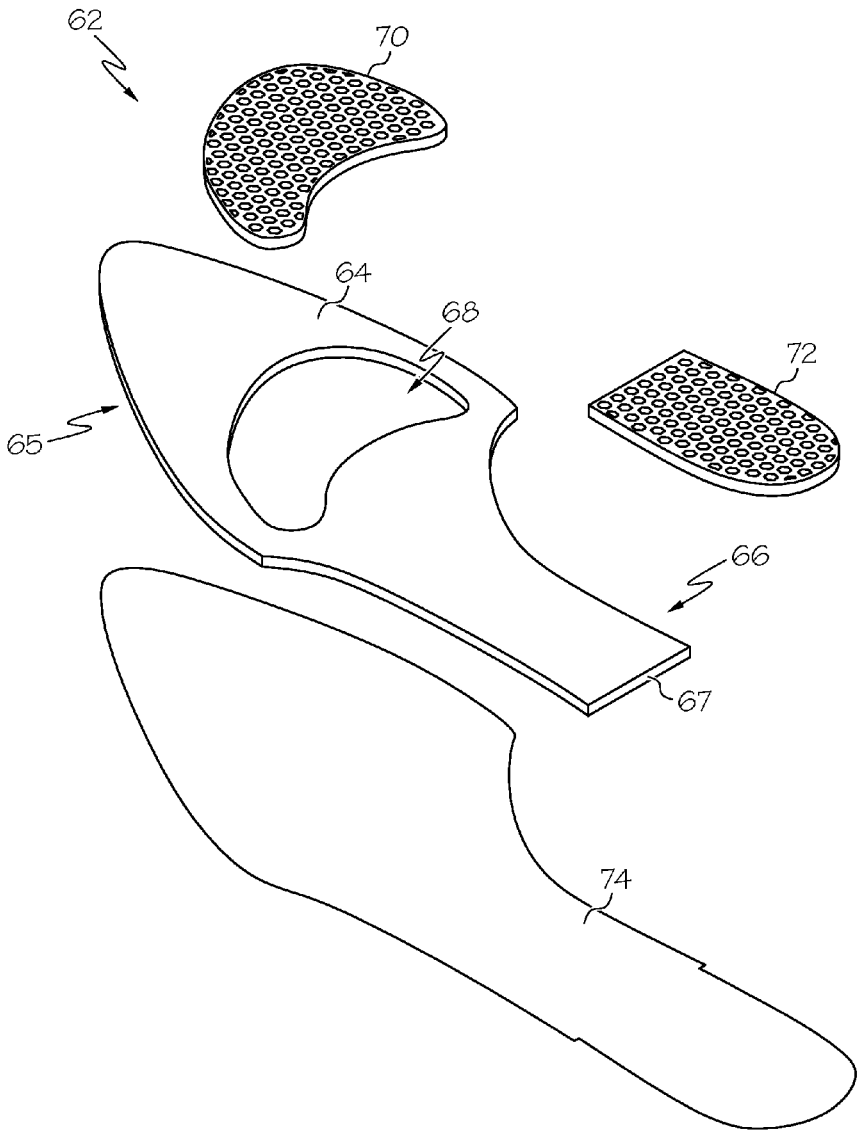
FIG. 5 is an assembly view of an upper insole portion of the footwear insole system of FIG. 3.
Figure 6:
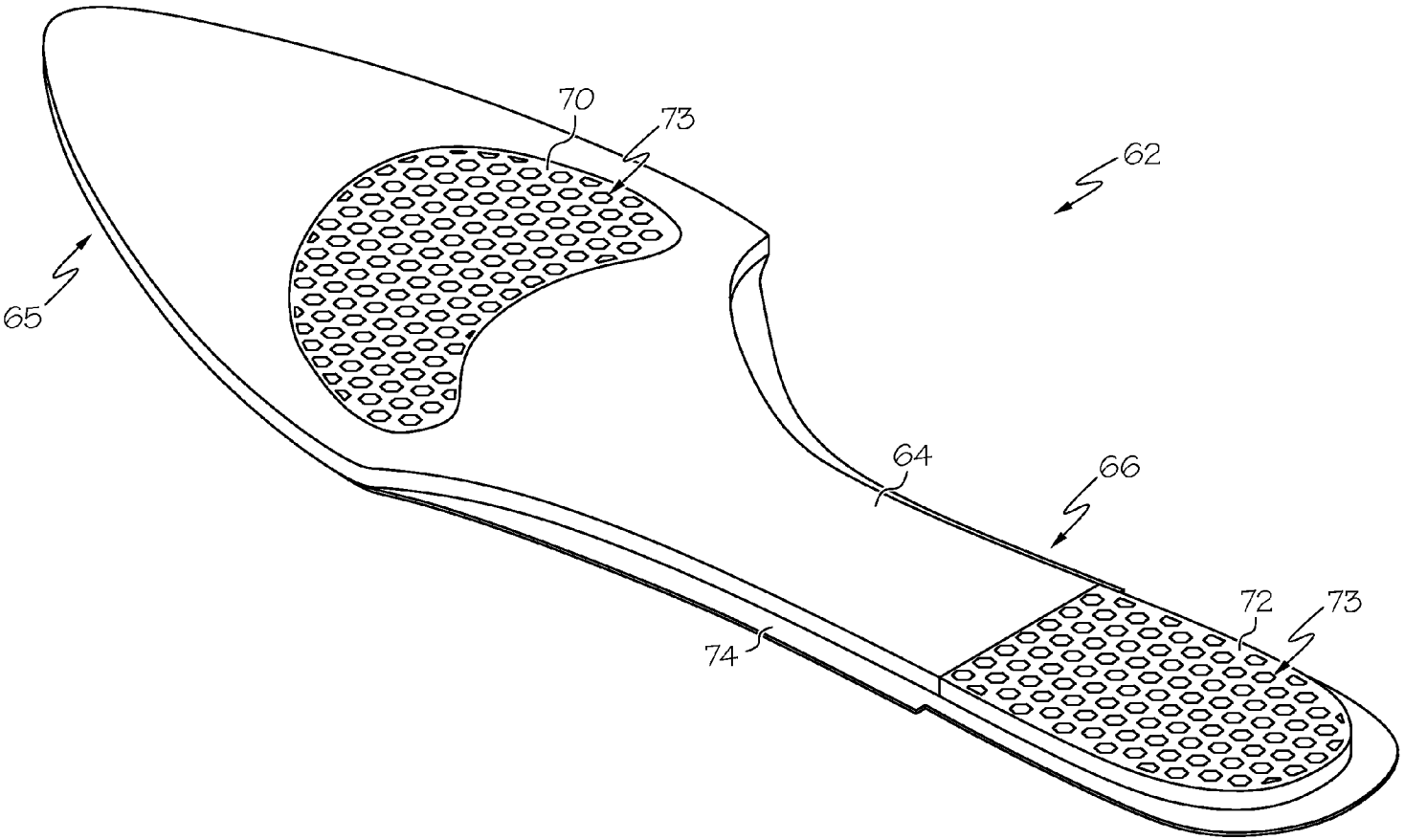
FIG. 6 is a bottom perspective view of the upper insole of FIG. 5, showing the components thereof assembled together.
Figure 7:
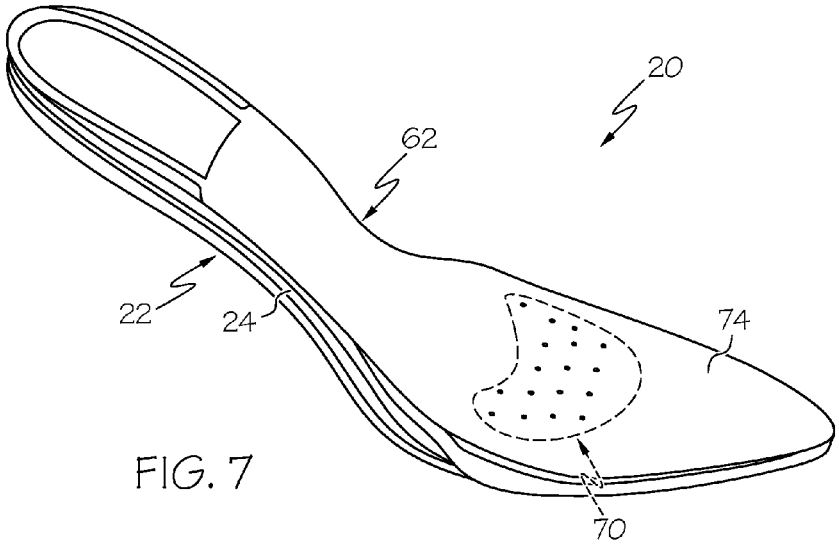
FIG. 7 is a side perspective view of the footwear insole system of FIG. 3, showing the upper insole sitting atop the base insole.
Figure 8:
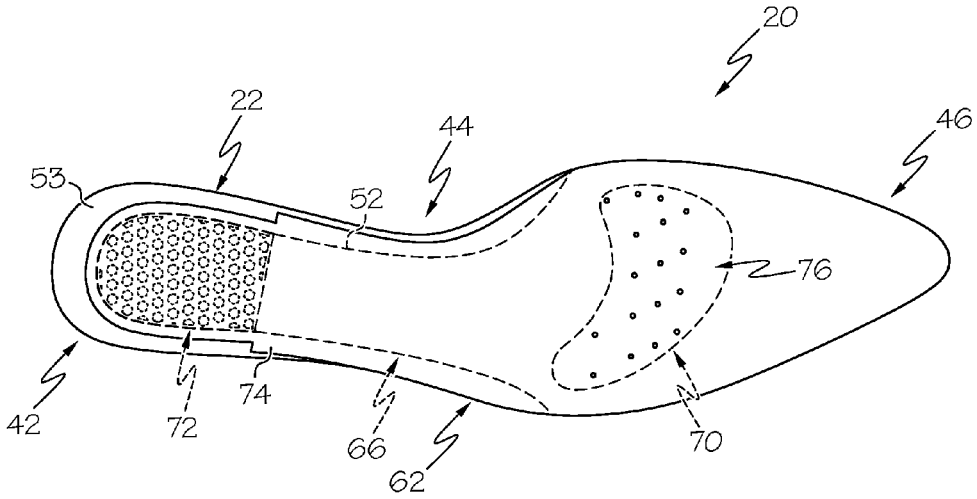
FIG. 8 is a top view of the footwear insole system of FIG. 7, showing the upper insole secured to the base insole.

FIGS. 5 and 6 show the upper insole 62 in greater detail. Generally, as briefly described above, the upper insole 62 comprises the spacer or insert member panel 64, the first and second gel insert members 70, 72, and the fabric cover sheet layer 74. As depicted, the spacer panel 64 is generally formed from a material having a uniform thickness and comprises a forefoot portion 65 and a midfoot portion 66. Preferably, an opening 68 is provided within the spacer panel 64 between the forefoot portion 65 and the midfoot portion 66 for receiving the first gel insert member 70 and an end surface 67 is provided near the midfoot portion 66 of the spacer panel 64 for attachment or abutment of a forward edge of the second gel insert member 72 thereto (see FIG. 6). Preferably, the outer contour of the opening 68 is substantially similar in shape to the outer contour of the first gel insert member 70 to provide a generally close or snug fit of the gel insert member into the opening. In example forms, the first and second gel insert members 70, 72 comprise a plurality of honeycomb or hexagon-shaped indentions or recessed cells 73 formed on one or both sides thereof, bounded by substantially upright flexible cell walls, which provide for additional comfort, adequate flexibility of the wearer's foot and distribution of a force applied thereon. The fabric sheet layer 74 is provided for substantially covering a side of the spacer panel 64 and the gel insert members 70, 72, and maintaining attachment of the insole components assembled therewith. Preferably, as shown in FIG. 6, portions of the fabric sheet layer 74 extend beyond the outer contour of the midfoot portion 66 and the affixed second gel insert 72 to provide an attachment surface for adhering to the outer rim-like surface or collar 53 of the base insole 22. In example embodiments, breathable holes or openings 76 are provided through the fabric sheet layer 74, to allow air movement, moisture dissipation and breathability for increased comfort (see FIGS. 7-8).

Preferably, the spacer panel 64 is formed from polyurethane (PU), the first and second gel inserts 70, 72 are formed from a thermoplastic elastomer (TPE) gel having nanoclay incorporated therein, and the fabric sheet layer 74 is formed from an antimicrobial microfiber fabric material. Optionally, the first and second gel inserts 70, 72 can comprise additional materials incorporated therein, for example, an antimicrobial material or others as desired. Typically, as described above, the antimicrobial characteristics incorporated within one or more components of the base or upper insole 22, 62 provide for preventing growth of bacteria that causes stains, odors and product deterioration.

In one example form, the spacer panel 64 is formed from a specific polyurethane material, for example, Poron® Performance Cushioning (available at www.poronsuchioning.com) that may vary in density from about 15 lb/ft$^3$ to about 25 lb/ft$^3$ and have a range of specific gravity from about 0.24 to about 0.40. Example qualities that provide superior benefit to the spacer panel 64 include but are not limited to superior shock absorption (lower peak deceleration, greater shock reduction), performance ability (long-term comfort, compression-set resistance, open-cell, breathable, Microban® antimicrobial protection) and versatility (available in a variety of densities, thicknesses (1.0 mm to 12.7 mm)). In example forms, the spacer panel 64 is generally formed from a large roll of the polyurethane sheet material, for example, wherein a die cutting machine is used to form the preferred shape of the spacer panel 64. Optionally, the spacer panel 64 may be formed in a plurality of other ways, which may include casting, stamping, molding, CNC, etc. Similarly, the fabric sheet layer is typically formed by die cutting the preferred shape from a roll of the antimicrobial microfiber fabric material. And, the first and second gel inserts 70, 72 are typically formed by injection molding. Optionally, various other manufacturing and assembly techniques may be employed to obtain the components and/or the assembled upper insole 62 including cutting, casting, molding, stamping, CNC, stitching, printing, heat bonding, couplings, hook and loop material, etc.

In example embodiments, the upper insole 62 is generally formed by molding the inserts onto the fabric sheet layer 74 and then aligning the spacer panel 64 with the fabric sheet layer 74 so that the inserts 70, 72 fit within portions thereof (e.g., insert 70 fitting within opening 68 and insert 72 fitting adjacent to surface 67). For example, in one example form, the fabric sheet layer 74 is placed within a mold machine and the inserts 70, 72 are molded onto the fabric, wherein the heat that provides attachment of the inserts 70, 72 provides attachment of the inserts to the fabric sheet layer 74. Alternatively or additionally, the inserts may be adhesively or otherwise attached to the fabric sheet layer. Thus, when placing the spacer panel 64 thereon, the inserts 70, 72 are free to float relative to the spacer panel and the base insole in response to movement or shifting of weight of the wearer. Preferably, the spacer panel 64 is fitted onto the fabric sheet layer 74 (and inserts 70, 72 molded thereto) without any form of adhesive or attachment. Optionally, an adhesive or other form of attachment can be provided to affix the spacer panel 64 to the fabric sheet layer 74, for example, wherein an adhesive is applied to one or more portions of the spacer panel 64 and/or the fabric sheet layer 74. Preferably, the gel insert members 70, 72 are not adhered or otherwise attached to the underlying base insole 22 or shock absorbing inserts 56, 60, but are allowed to compress and move under load for increased comfort and weight distribution when worn, and to resist shifting of the foot within the shoe (i.e., to substantially lock the foot in position on the insole to prevent shifting forward in the footbed).

In alternate example embodiments, the first and second gel inserts 70, 72 can be affixed in place in or on the spacer panel 64, and the fabric sheet layer 74 can then be affixed to the panel 64 with an adhesive. For example, an adhesive may be applied to the outer periphery of the first gel insert 70 and the insert 70 is fitted within the opening 68, thus coupling the outer periphery of the first gel insert 70 to the outer contour of the opening 68. For affixing the second gel insert 73 to the spacer panel 64, an adhesive is applied to an end surface of the second gel insert 72 and the end surface of the insert 72 is affixed to the end surface 67 of the spacer panel 64. And, for affixing the fabric sheet layer 74, an adhesive is more or less applied across the surface of the sheet layer 74 and the sheet layer 74 is affixed to the spacer panel 64. Optionally, the adhesive can be selectively applied on the sheet layer 74 to only adhere at one or more portions of the spacer panel 64. Preferably, the adhesive is in the form of a glue, resin, cement, or other type of bonding material. Optionally, the panel 64, inserts 70, 72 and fabric sheet layer 74 can be affixed together by other adhesives, heat bonding, stitching, injection molding, etc. Optionally, the inserts 70, 72 are separately formed (not molded onto the fabric sheet layer 74) and can be adhered to the fabric sheet layer 74 with an adhesive, by stitching, or other attachment means. Optionally, the spacer panel 64 can be adhered to the sheet layer 74 prior to adhering the inserts 70, 72 to the spacer panel 64 and/or sheet layer 74. Alternatively, the gel insert members 70, 72 are not adhered or attached to the spacer panel 64, but are held in place by being sandwiched in close fit between the surrounding components.

Generally, the insole system 20 may be either permanently secured to the internal portion of the upper 12 (accessible through the opening 18) of a shoe or other article of footwear, or the insole system 20 may be added or removed from the article of footwear 10 by insertion or removal through the opening 18. As described above, it is preferred that portions of the insole system 20 are constructed or assembled with the article of footwear 10 at different stages of the construction or assembly of the article of footwear 10. For example, the chassis 24 and the shock absorbing insert 56 are typically assembled when forming the upper 12 and outsole 14, and the second shock absorbing insert 60 and upper insole 62 are assembled at a later stage. In one example form, the second shock absorbing insert 60 and the upper insole 62 are assembled during the construction of the article of footwear 10 (permanently secured or replaceable/interchangeable), but after at least constructing the upper 12 (comprising the chassis 24 and the first shock absorbing insert 56). In another example form, the second shock absorbing insert 60 and/or the upper insole 62 can be installed during a post-construction or assembly process or other later time including once the footwear 10 has been worn by a user. For example, it may be desired to provide a replacement upper insole 62 and/or the second shock absorbing insert 60 to replace the current upper insole 62 and/or second shock absorbing insert 60 after the article of footwear 10 has been used. In this manner, the insole system of the present invention can be installed during construction as original equipment within a shoe designed to incorporate the insole system, or can be retrofit into the construction of a standard shoe design, or can be installed in an existing shoe after construction. Optionally, the entire insole system 20 can be assembled at the same stage and then be permanently secured or replaceable/interchangeable with the article of footwear 10 during or after the construction process thereof.

In example forms, the base insole 22 is generally affixed to an internal portion of the upper 12 by applying an adhesive to the bottom side 30 of the chassis or base layer 24, the internal portions of the upper 12, or both. Optionally, stitching, molding or other adhering methods may be used to affix the base insole 22 to the upper 12 (and/or midsole as described above). If the second shock absorbing insert 60 has not been secured to the central well 50, the insert 60 is then secured to the central well 50, which is typically accomplished with an adhesive. Optionally, the other adhering methods listed above and others may be used. Typically, the upper insole 62 is inserted within the opening 18 (aligning the forefoot portion 65 with the forefoot portion 46, see FIG. 7) and the midfoot portion 66 and the affixed heel portion 72 are then inserted within the central well 50 and between the peripheral wall 52 (see FIG. 8). To permanently secure the upper insole 62 to the chassis 24 of the base insole 22, adhesive is applied to the lip or collar 53 or the exposed portions of the fabric sheet layer 74 extending beyond the periphery of the midfoot portion 66 and the second gel insert 72, or both. Optionally, other adhering methods may be provided to affix the upper insole 62 to the base insole 22. Optionally, the adhesive can be applied to the lip 53 and/or fabric sheet layer 74 prior to placing the upper insole 62 atop the base insole 22. Further optional, the adhesive can be applied to the exposed (bottom side of the spacer panel 64), which will contact and adhere to the chassis 24 of the base insole 22. Preferably, the first and second gel inserts 70, 72 remain free from engagement with the chassis 24 and/or central well 50, thus allowing the inserts 70, 72 to generally float atop the shock absorbing inserts 56, 60 of the base insole 22, respectively. In some example forms, at least some portions of the outer periphery of the spacer panel 64 and/or the second gel insert 72 can be secured to the peripheral wall 52, or alternatively may be unsecured. Further optionally, the upper insole 62 and/or shock absorbing insert 60 are replaceable or interchangeable, to be installed or removed from the article of footwear 10 by insertion or removal through the opening 18. Thus, the upper insole 60 and/or shock absorbing insert 60 may be generally seated within or interengage the base insole 22 and provide a substantially snug fit while also providing for replacing or interchanging therefrom.

In other aspects, the present invention relates to a method of assembling an article of footwear. Generally, the method comprises forming a footwear upper comprising a footbed or midsole therein, mounting an outer sole member to the midsole and/or to the upper, affixing a base insole 22 to the midsole and/or footbed within the upper 12, and affixing an upper insole 62 to the base insole 22. As described above, the outer member can be mounted to the bottom of the upper 12, which may comprise the midsole mounted therein. Further, as described above, the base insole 22 can be affixed to the upper insole 62 prior to affixing the base insole 22 to the midsole (and/or internal portions of the upper 12). One or more gel insert members are held in place between the base insole and the upper insole, preferably without attachment that would otherwise restrict movement of the gel insert members in compression.

While the invention has been described with reference to preferred and example embodiments, it will be understood by those skilled in the art that a variety of modifications, additions and deletions are within the scope of the invention, as defined by the following claims.

What is claimed is:

1. An insole system for an article of footwear comprising:

a base insole comprising a chassis having an upper surface and a lower surface, a lateral side and a medial side, a heel end and a forefoot end, and a heel portion, a midfoot portion, and a forefoot portion, wherein the chassis defines a central well formed at the heel portion, the central well comprising a peripheral wall defined along the well at the heel portion and extending along the lateral and medial sides of the chassis until gradually tapering at the midfoot portion, the peripheral wall defining a collar surface that is generally transverse the wall and between the wall and an outer contour of the chassis;

first and second shock absorbing inserts mounted to the chassis, the first shock absorbing insert mounted to the forefoot portion, and the second shock absorbing insert mounted to the heel portion; and an upper insole mounted to the upper surface of the chassis and comprising a spacer panel having at least one opening formed therein, first and second gel insert members, and a fabric sheet, wherein the spacer panel extends along the midfoot and forefoot portions of the base insole, the first gel insert member being fitted within the opening of the spacer panel to be adjacent the first shock absorbing insert, the second gel insert member abutting a portion of the spacer panel proximal the midfoot portion and being adjacent the second shock absorbing insert, and the fabric sheet mounted atop the spacer panel and the first and second gel insert members.

2. The insole system of claim 1, wherein the chassis is formed from a high density polyethylene material and the first and second shock absorbing inserts are formed from a polyurethane material.

3. The insole system of claim 1, where in the spacer panel of the upper insole is formed from a polyurethane material and the first and second gel insert members are formed from a thermoplastic elastomer material.

4. The insole system of claim 3, wherein the first and second gel insert members comprise a nanoclay gel material defining a cell pattern.

5. The insole system of claim 4, wherein the cell pattern is a hexagon-shaped honeycomb pattern with a plurality of recessed cells bounded by upright cell wall segments.

6. The insole system of claim 1, wherein the upper insole is affixed to the base insole by adhering a portion of the fabric sheet to the collar surface of the chassis.

7. The insole system of claim 6, further comprising adhering the spacer panel to the upper surface of the chassis.

8. The insole system of claim 1, wherein at least one of the chassis, the shock absorbing inserts, the spacer panel, the gel insert members and the fabric sheet comprise antimicrobial materials.

9. A footwear insole system comprising:

a base insole comprising a chassis and first and second shock absorbing inserts, the chassis having an upper surface and a lower surface, a lateral side and a medial side, a heel end and a forefoot end, and a heel portion, a midfoot portion and a forefoot portion; and an upper insole mounted to the upper surface of the chassis, the upper insole comprising a spacer panel, first and second gel insert members and a fabric sheet layer;

wherein the chassis defines a central well formed at the heel portion, the central well comprising a peripheral wall defined along the well at the heel portion and extending along the lateral and medial sides of the chassis until gradually tapering at the midfoot portion, the peripheral wall defining a outer collar that is generally transverse the wall and between the wall and an outer contour of the chassis.

10. The footwear insole system of claim 9, wherein the first shock absorbing insert is mounted to the forefoot portion and the second shock absorbing insert is mounted to the central well at the heel portion.

11. The footwear insole system of claim 9, wherein the spacer panel comprises at least one opening formed therein for receiving the first gel insert member therein.

12. The footwear insole system of claim 11, wherein the spacer panel further comprises an end surface near a midfoot portion thereof for abutment with the second gel insert member.

13. The footwear insole system of claim 9, wherein the fabric sheet layer is mounted atop the spacer panel and the first and second gel insert members, a portion of the fabric sheet layer extends beyond the outer periphery of the spacer panel and the first and second gel insert members for affixing to the outer rim-like surface of the chassis.

14. The insole system of claim 9, wherein the chassis is formed from a high density polyethylene material and the first and second shock absorbing inserts are formed from a polyurethane material.

15. The insole system of claim 9, where in the spacer panel of the upper insole is formed from a polyurethane material and the first and second gel insert members are formed from a thermoplastic elastomer material.

16. The insole system of claim 15, wherein the first and second gel insert members comprise a gel having a nanoclay incorporated therein.

17. The insole system of claim 16, wherein the first and second gel insert members have a cell pattern incorporated therein.

18. The insole system of claim 17, wherein the cell pattern comprises a plurality of hexagon-shaped honeycomb cell recesses bounded by cell wall structures.

* * * * *